US010486154B2

(12) United States Patent
Benco et al.

(10) Patent No.: US 10,486,154 B2
(45) Date of Patent: Nov. 26, 2019

(54) MICROFLUIDIC DEVICE

(71) Applicant: Siemens Healthcare Diagnostics Inc., Tarrytown, NY (US)

(72) Inventors: John Benco, Holliston, MA (US); Joyce Jordan, Walpole, MA (US)

(73) Assignee: Siemens Healthcare Diagnostics Inc., Tarrytown, NY (US)

( * ) Notice: Subject to any disclaimer, the term of this patent is extended or adjusted under 35 U.S.C. 154(b) by 0 days.

(21) Appl. No.: 15/303,882

(22) PCT Filed: Apr. 13, 2015

(86) PCT No.: PCT/US2015/025554
§ 371 (c)(1),
(2) Date: Oct. 13, 2016

(87) PCT Pub. No.: WO2015/164112
PCT Pub. Date: Oct. 29, 2015

(65) Prior Publication Data

US 2017/0043341 A1 Feb. 16, 2017

Related U.S. Application Data

(60) Provisional application No. 61/984,213, filed on Apr. 25, 2014.

(51) Int. Cl.
*B01L 3/00* (2006.01)

(52) U.S. Cl.
CPC ..... *B01L 3/502715* (2013.01); *B01L 3/5023* (2013.01); *B01L 3/502707* (2013.01);
(Continued)

(58) Field of Classification Search
CPC ..... B01L 3/502715; B01L 3/502723; B01L 3/502707; B01L 3/5023; B01L 2200/12;
(Continued)

(56) References Cited

U.S. PATENT DOCUMENTS

2003/0104510 A1* 6/2003 Yu ..... G01N 33/525 435/25
2009/0298191 A1 12/2009 Whitesides et al.
(Continued)

FOREIGN PATENT DOCUMENTS

EP 1318397 A1 6/2003
WO 2013036617 A1 3/2013
(Continued)

OTHER PUBLICATIONS

Nie et al., Low-Cost Fabrication of Paper-Based Microfluidic Devices by One-Step Plotting, 2012, American Chemical Society, p. 6331-6335 (Year: 2012).*
(Continued)

*Primary Examiner* — Lore R Jarrett
(74) *Attorney, Agent, or Firm* — Dunlap Codding P.C.

(57) ABSTRACT

A microfluidic device 10 is provided that includes a porous substrate 12 and a plurality of reaction channels 14 disposed on a first side 36 of the porous substrate 12. The reaction channels 14 are defined by a barrier material 16 disposed on the substrate 12 in a user-defined pattern 13. At least one reagent 18 is disposed within each reaction channel 14 in an amount effective to test for the presence of at least one analyte or property in a sample introduced to the device 10.

13 Claims, 3 Drawing Sheets

(52) U.S. Cl.
CPC ..... *B01L 3/502723* (2013.01); *B01L 2200/12* (2013.01); *B01L 2300/0816* (2013.01); *B01L 2300/0864* (2013.01); *B01L 2300/0874* (2013.01); *B01L 2300/0887* (2013.01); *B01L 2400/0406* (2013.01)

(58) Field of Classification Search
CPC ..... B01L 2300/0874; B01L 2300/0816; B01L 2400/0406; B01L 2300/0887; B01L 2300/0864; B01L 3/502738; B01L 2400/0672; B01L 2400/0633; B01L 2300/1877; B01L 2300/1855; B01L 2300/126; B01L 2300/087; B01L 2300/0867; B01L 7/525; F16K 99/0015; F16K 99/0001; F16K 99/0025; F16K 2099/008; Y10T 436/25
See application file for complete search history.

(56) References Cited

U.S. PATENT DOCUMENTS

| | | | |
|---|---|---|---|
| 2011/0207328 | A1 | 8/2011 | Speakman |
| 2012/0164627 | A1 | 6/2012 | Battrell et al. |
| 2013/0034869 | A1 | 2/2013 | Whitesides et al. |

FOREIGN PATENT DOCUMENTS

| | | | |
|---|---|---|---|
| WO | 2013067272 | A1 | 5/2013 |
| WO | 2013181656 | A1 | 12/2013 |

OTHER PUBLICATIONS

International Search Report and Written Opinion of International Application No. PCT/US2015/025554 dated Jul. 8, 2015.
Martinez et al., "Three-dimensional microfluidic devices fabricated in layered paper and tape", Dec. 16, 2008, PNAS, vol. 105, No. 50, pp. 19606-19611.
Li et al., "A Perspective on Paper-Based Microfluidics: Current Status and Future Trends", 2012, Biomicrofluidics 6, 011301, pp. 1-14.
Liu et al., "Aptamer-Based Origami Paper Analytical Device for Electrochemical Detection of Adenosine", 2012, Angew. Chem. Int. Ed. vol. 51, pp. 6925-6928.
Schilling et al., "Fully Enclosed Microfluidic Paper-Based Analytical Devices", 2012, Anal. Chem. 84, pp. 1579-1585.
European Search Report and Written Opinion of European Application No. 15783494.6 dated Mar. 23, 2017.
European Office Action of European Application No. 15783494.6 dated Mar. 18, 2019.

* cited by examiner

MICROFLUIDIC DEVICE

The subject application claims benefit under 35 USC § 119(e) of U.S. provisional Application No. 61/984,213, filed Apr. 25, 2014. The entire contents of the above-referenced patent application are hereby expressly incorporated herein by reference.

FIELD OF THE INVENTION

The present invention relates to the field of disposable, multi-purpose diagnostic tests and to methods of manufacturing the same.

BACKGROUND OF THE INVENTION

In the past several years, paper-based devices have emerged as inexpensive platforms for simple qualitative and semi-quantitative colorimetric assays. See, for example, Li, X. et al., Biomicrofluidics, 2012, 6, 11301. For example, three-dimensional (3D) structures have been developed that allow for the measurement of multiple analytes on a single device. See, for example, Martinez, A. W. et al., Proc Natl Acad Sci 2008, 105, 19606). Recently, devices have been developed that enclose a reaction site with printing toner yielding an assay that is protected from the environment, and is more akin to conventional plastic-based microfluidic devices. See, for example, Schilling K. M. et al., Anal Chem, 2012, 84, 1579. However, this device is complicated in structure, is difficult to use, and requires significant amount of time (>60 min) to construct. In addition, yellow toner is required to be printed over the reaction/detection area to enclose Schilling's device. The yellow colorant may interfere with the chemistries of other reactions, may mask or alter the true color of a result, and thus may render analysis more difficult. Further, the device described by Schilling, et al. does not enable assay expansion with ease; therefore, its utility is limited.

A laminated self-powered, electrochemical device has also been reported by Liu et al. (Angew Chem. Int. Ed., 2012, 51, 1). This device is referred to as an "origami paper analytical device (oPAD)," and is based on a chemical reaction yielding a measurable current as a function of analyte concentration. This device is also complicated to make (includes many steps, layers, and is time consuming), requires folding steps, and requires a four sided process to laminate the structure. In addition, it may take approximately 10 minutes for a sample to fill the device before a measurement can take place for a single analyte. This time period is often too long for time-sensitive diagnostics.

BRIEF DESCRIPTION OF THE DRAWINGS

The invention is explained in the following description in view of the drawings that show.

DETAILED DESCRIPTION OF THE INVENTION

Aspects of the present invention are directed to an easily produced, customizable microfluidic device. The device may be utilized for health-related diagnostic tests such as medical diagnosis, water quality, food quality, and the like. Advantageously, the device may be formed from inexpensive consumer products such that the device may be quickly manufactured and utilized where resources are limited. These devices are not only inexpensively constructed from low cost materials and are simple to manufacture, but are also highly flexible (in terms of assay expansion), may withstand exposure to a wide range of environmental conditions, require only small sample sizes, and provide fast results.

Figure 1:
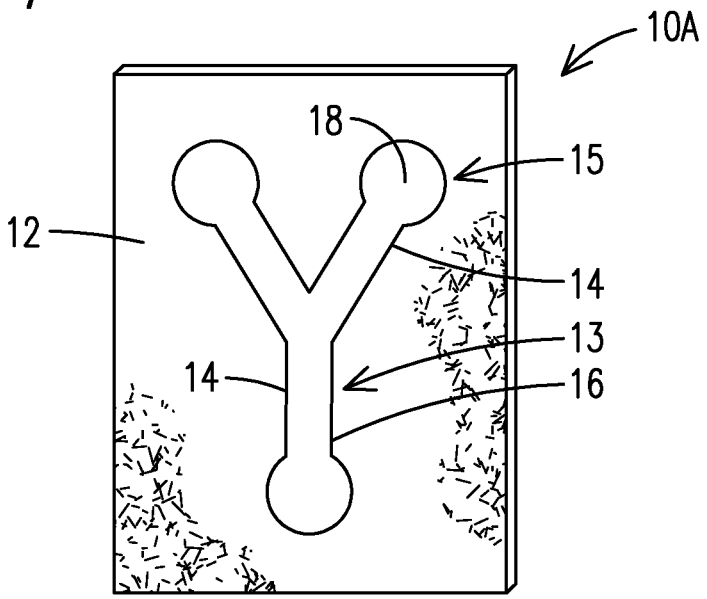
FIG. 1 illustrates a microfluidic device in accordance with an aspect of the present invention.

Referring now to FIG. 1, FIG. 1 illustrates a device 10 in accordance with an aspect of the present invention that is simple to construct and allows for multiple assays. The device 10A comprises a substrate 12 and at least one reaction channel 14 defined on a first side of the substrate 12 in a pattern 13. At least a portion of boundary of the reaction channel 14 is defined by a barrier defining material 16 (hereinafter "barrier material 16"), which acts as a barrier for a sample and defines at least a portion of a perimeter or an outer boundary of each reaction channel 14. In one aspect, the barrier material 16 may have a lower porosity and/or a higher degree of hydrophobicity than the substrate 12 so as to maintain an aqueous or a hydrophilic sample within its boundaries. At least one reagent 18 is disposed within at least a portion the reaction channel 14 at a reaction site 15 in an amount effective to indicate the presence of a predetermined analyte or the presence of a property in a sample, e.g., a test sample, which is introduced into the device 10A. In certain embodiments, the reagent 18 is useful for colorimetric indication of the presence of one or more predetermined analytes or one or more properties in a sample, such as a colorimetric indication of glucose levels in a biological sample.

Figure 2:
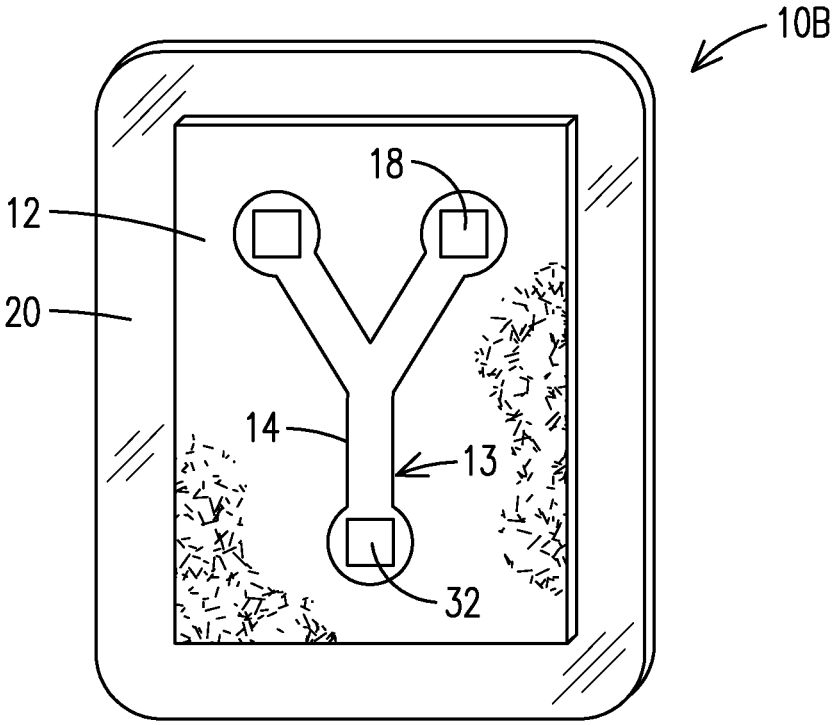
FIG. 2 illustrates a microfluidic device having a backing in accordance with another aspect of the present invention.

In certain embodiments, the substrate 12 is self-supporting. In other embodiments, the device 10B comprises a substrate 12 coupled with a backing 20 as shown in FIG. 2. The backing 20 may be formed from a liquid impermeable material, such as a polymeric material. The substrate 12 may be secured to the backing 20 by any suitable structure such as tabs, clips, an adhesive, or the like.

Figure 3:
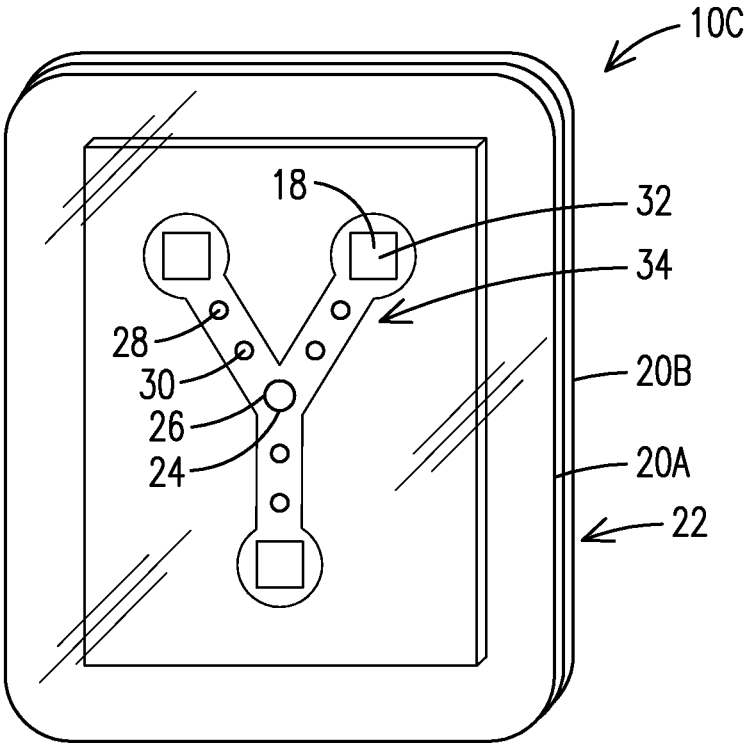
FIG. 3 illustrates an enclosed laminated microfluidic device in accordance with another aspect of the present invention.

In still another embodiment, the substrate 12 is disposed (sandwiched) between a first backing and a second backing and secured thereto by any suitable structure or process, such as by laminating and/or the use of tabs, clips, an adhesive, or the like. For example, as shown in FIG. 3, there is shown a device 10C comprising substrate 12 having reaction channels 14 disposed within a laminate structure 22 comprising a first backing 20A a second backing 20B laminated with the substrate 12 under suitable temperature and/or pressure to protect the substrate 12 from environmental conditions and maintain the integrity of the test enabled by the reagent 18. The laminate structure 22 may simplify construction of the device. For example, when wax is utilized as the barrier material 16, a laminating process may both enclose the device 10C and define the reaction channels 14 simultaneously.

The laminate structure 22 comprising backings 20A, 20B may be in the form of a commercially available laminate pouch made from a polymeric material and a suitable heat melt adhesive (In a particular embodiment, the substrate 12 is positioned between the first backing 20A and the second backing 20B and the backings, substrate, and reagent(s) are collectively laminated under pressure and/or heat to form the enclosed microfluidic device 10C. When a laminate structure 22 is provided, at least one of the first backing 20A and the backing 20B may comprise one or more first apertures 24 that serve as a respective sample port 26 for receiving a sample to be distributed to the reaction channels 14 in fluid communication with the sample port 26. In addition, the device 10C may comprise one or more second apertures 28 disposed over each reaction channel 14 that serve as respective vents 30 in the device 10.

The substrate 12 may be any suitable porous or non-porous material. In certain embodiments, the substrate 12 comprises a porous material. The porous material may comprise a cellulosic material, a glass fiber material, a porous polymeric material, or combinations thereof. In particular embodiments, the substrate 12 is provided from a common consumer item, which is inexpensive and readily available, such as a paper towel. With a porous material, it is generally understood that the barrier material 16 and the reagent(s) 18 may be disposed on a surface of the substrate 12 and/or within pores of the substrate 12.

In the embodiment shown in FIG. 3, there are three reaction channels 14 defined to define the pattern 13. However, it is understood that the present invention is not so limited and any number of reaction channels 14 may be defined in the device 10. For example, the device may be patterned so as to provide a device with two, four, six, eight, ten or any other number of channels 14. In addition, the channels 14 may be of any suitable length and width to accomplish the objectives of the assay to be performed within the reaction channel 14. Advantageously, the simple construction of the devices described herein enables assay expansion since the user may quickly customize a device to include a greater or smaller number of reaction channels 14 as desired. For example, if one wished to expand the device to accommodate six different assays instead of four, one could do so by simply drawing, printing, or otherwise defining two additional reaction channels 14 in the pattern and disposing the desired reagent(s) within the channels 14 for the relevant test to be administered.

The barrier material 16 may be any suitable material effective to form a barrier to a sample introduced into the sample and define a path (e.g., a reaction channel 14) for the sample. In an embodiment, the barrier material 16 has a lower porosity and/or a higher degree of hydrophobicity than the substrate 12 so as to maintain a sample within a boundary defined by the barrier material 16. In certain embodiments, the material 16 may be a hydrophobic material including but not limited to one or more components selected from the group consisting of hydrophobic polymers, permanent inks, waxes, or any other suitable hydrophobic material. In particular embodiments, the material 16 may comprise a consumer product, such as ink from a permanent marker such as a Sharpie® marker or correction fluid as is commercially available, such as Liquid Paper® or Bic Wite Out®. In other embodiments, the barrier material is a printer ink.

Advantageously, the number, length, width, and/or depth of the reaction channels 14 may be user-defined such that a desired number of reaction channels 14 and reaction sites 15 having a desired pattern 13 are formed in the device 10. As will be discussed further below, the devices described herein may be formed from common consumer goods such that they are inexpensive, offer variability, and are easy to manufacture. The reaction channels 14 may be defined on the substrate 12 by any suitable method, such as by drawing, painting, and/or printing the material 16 in a desired pattern 13 on the substrate 12. In one embodiment, the reaction channels 14 are defined by disposing the barrier material 16 on a single side of the device 10 in a pattern 13. In other embodiments, the reaction channels are defined by disposing the barrier material on both sides of the substrate 12 in at least substantially the same pattern 13.

To test for the presence of one or more target analytes in a sample or a property of a sample, the reaction channels 14 are filled with one or more reagents 18 capable providing at least a qualitative indication of the presence of an analyte in a sample and/or of a property of the sample. In certain embodiments, the one or more reagents 18 may provide for the semi-quantitative indication of one or more analytes or properties in a sample, such as by comparing a test result to values on a calibration curve created from a plurality of standard samples having predetermined concentrations. In one aspect, the one or more reagents 18 provide for a colorimetric response. In a particular embodiment, the one or more reagents 18 provides for the colorimetric analysis of glucose, proteins, ketones, and/or nitrites in a urine sample. This is accomplished by disposing a suitable reagent 18 for the respective assay within a respective channel 14.

Any suitable method for disposing the one or more reagents 18 within a respective channel may be utilized. In certain embodiments, the one or more reagents 18 are applied by dipping, spraying, painting, laminating, etc. the one or more reagents 18 on the substrate 12. In another embodiment, as shown in FIG. 2, the one or more reagents are added to a second substrate which is maintained in a fixed position on the substrate 12 by any suitable structure, such as an adhesive, or by laminating the second substrate with the substrate 12. In a particular embodiment, the one or more reagents 18 are disposed on a commercially available test strip 32 as is also shown in FIGS. 2-3. The test strip 32, or a portion thereof, may be placed within an associated reaction channel 14 (before or after formation of the reaction channel 14) at a desired location. In certain embodiments, the test strip 32 is cut to fit within a particular reaction channel 14. For example, the test strip 32 may be placed at a terminal end 34 of the reaction channel 14 as is shown in FIGS. 2-3. The location of the one or more reagents 18 defines the reaction site 15. Thus, where a test strip 32 is placed will define a corresponding reaction site 15. In an embodiment, the test strip 32 is secured to the substrate 12 and/or laminated between the first backing 20A and second backing 20B on the substrate 12.

In a particular embodiment, the test strip 32 comprises a Multistix 10 SG Reagent Strip commercially available from Siemens AG. The Multistix 10 SG Reagent Strip test strip 32 may be secured (by adhesive or the like) or laminated to be fixed substantially or completely within the boundaries of a respective reaction channel 14. Advantageously, the Multistix 10 SG Reagent Strips may test for a plurality of markers on a single strip. In particular, the strips may provide a colorimetric analysis for any one or more of glucose, bilirubin, ketones, specific gravity, blood, pH, protein, urobilinogen, nitrite, leukocyte, and esterase, for example. Alternatively, the test strip 32 may be configured and comprise reagent(s) suitable for determining the absence or presence of any other analyte(s) in a sample or a property of a sample.

The first aperture 24 may be of a size effective to provide sufficient sample to accomplish the desired objective(s) of the diagnostic test(s) as would be appreciated by the skilled artisan. FIG. 3 shows a centrally located aperture 24 defining a single sample port 26 from which the sample travels radially outward to each of the reaction channels 14 by capillary action. However, it is appreciated that the present invention is not so limited. In certain embodiments, more than one sample port 26 may be provided on the device for receiving a sample which will travel to a respective reaction site by capillary action. Multiple sample ports may be advantageous when, for example, it is desired that a sample be directed to a particular one(s) of the reaction channels 14, but not others. This could be the case, for example, if providing different standard or control samples to the device 10 in order to provide a calibration or standard curve.

The sample to be introduced may comprise any one or more of water, urine, saliva, and blood. The samples may undergo any pre-treatment or filtration process as is known in the art in preparation for analysis prior to introduction of the sample to the device 10. In certain embodiments, a number and size of first and second apertures 24, 28 are selected to facilitate capillary flow of a sample introduced into the sample port 26 to a respective end 34 of the reaction channel 14.

The following describes an exemplary method for making a device as described herein, such as the device of FIG. 3. In one embodiment, the method of making a microfluidic device comprises defining one or more reaction channels 14 on a first side of a porous substrate 12 by disposing a barrier material 16 on the substrate 12. The defining of the one or more reaction channels 14 may be done by drawing, painting, or printing the material 16 in the desired pattern 30 on the substrate 12. In certain embodiments, 2, 4, 6, or 8 reaction channels 14 are formed on the substrate, each of which extend radially outward from a corresponding sample port.

In the method, one or more reagents 18 are next disposed within the one or more reaction channels 14 in an amount effective to test for the presence of one or more predetermined analytes or properties, such as for glucose, bilirubin, ketones, specific gravity, blood, pH, protein, urobilinogen, nitrites, leukocytes, and esterases, for example. As set forth above, at least a portion of one or more test strips 32 may be placed within the boundaries of a respective reaction channel 18 to define a reaction site 15. In certain embodiments, the one or more reagents 18 are applied to the substrate 12 such that the one or more reagents 18 are carried by the substrate 12. For example, when a test strip 32 is utilized carrying the one or more reagents 18, the test strip 32 may be adhered or otherwise secured against the substrate 12. In a particular embodiment, at least a portion of the test strip 32 is placed within each respective reaction channel 14 and is thereafter laminated into a fixed position on the substrate 12. Advantageously, the test strip 32 provides each channel 14 with a depth and vehicle through which a sample can travel through by capillary action.

When a laminate structure 22 is used comprising a first backing 20A and a second backing 20B as was shown in FIG. 3, the process of manufacture may include forming one or more first apertures 24 in the first backing 20A and/or the second backing 20B to serve as one or more corresponding sample ports 26. The formation of the one or more first apertures 24 may be done by any suitable device for forming an aperture, such as a whole punch or the like.

In addition, one or more second apertures 28 which will serve as one or more corresponding vents 30 for the device 10 may be formed in the first backing 20A and/or the second backing 20B. The vents 30 are position so as to overlay and be encompassed within the boundaries of the reaction channel 14 when the substrate 12 is finally disposed between the backings 20A, 20B. In this way, the vents 30 will optimally facilitate filling of the sample into the area defined by the reaction channel 14. The formation of the vents 30 may be done by any suitable device for forming an aperture, such as a whole punch, push pins, safety pins, or the like. In certain embodiments, the first and second apertures 24, 28 may be collectively and simultaneously formed utilizing a single device, such as a punch or other implement.

After the forming of the sample port(s) 26 and vent(s) 30, the substrate 12 and the reagent 18, e.g., test strip 32, may be laminated between the first backing 20A and/or the second backing 20B of a laminate structure 22 under suitable pressure and/or heat conditions as are known in the art. In certain embodiments, the laminate structure 22 may be in the form of a pouch. In certain embodiments, the laminate structure 22 may comprise a commercially available polymer with an adhesive as is known in the art, such as a polyester or Mylar® material with extruded heat seal adhesive.

Figure 4:
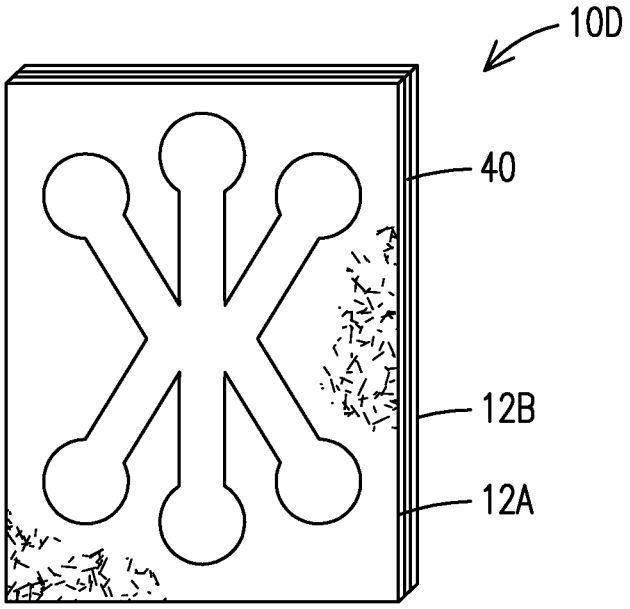
FIG. 4 illustrates a two-sided microfluidic device in accordance with yet another aspect of the present invention.

The device may be provided as a single-sided device as described up to this point. However, the present invention is understood to be not so limited. In another embodiment, however, as shown in FIG. 4, a device 10D is provided as a two-sided device having reaction channels 14 and one or more reagents 18 on a first side 36 and a second side 38 of the device. Each side 36, 38 may have a substrate 12 having one or more reaction channels 14 defined therein. Typically, the device 10D may include a substantially impermeable layer 40 disposed in between the first side 36 and the second side 38 to prevent transfer of sample/fluid between the first side 36 and the second side 38 and/or to allow for the introduction of distinct samples to the first side 36 and the second side 38. The impermeable layer 40 may be made from a hydrophobic material or polymer, such as a rubber, polyurethane, polytetrafluoroethylene (PTFE), or the like.

In another aspect, there is provided one or more of the devices as described herein stacked on top of one another in the form of an enclosed three-dimensional device. These devices have at least two substrates having reaction channels defined therein and may utilize a backing between each substrate to separate the substrates from one another, and as a front and rear cover for the device. For example, in the exploded view shown in FIG. 5, there is shown a device 10E comprising a first backing 20A having a plurality of second apertures 28 that serve as vents 30, which will be positioned over corresponding reaction channels 14 upon lamination of the components. Below the first backing 20A, a first substrate 12A is provided having reaction channels 14 defined by a barrier material 16 as described herein. One or more reagents 18, such as on a test strip 32, are provided within a respective reaction channel 14 to define a respective reaction site 15. Below the first substrate 12A, a second backing 20B is then provided having a first aperture 26 defined therein. The providing of a first aperture 24 in the second backing 20B contributes to allow a single sample port to be utilized for at least two distinct substrates 12A, 12B with respective reaction channels 14 on opposite sides of the device. This allows for testing on both sides of the device 10E from a single sample introduction site.

Below the second backing 20B, a second substrate 12B is provided having reaction channels 14 defined by the barrier material 16. One or more reagents 18, such as on a test strip 32, are also provided within a respective reaction channel 14 to define a respective reaction site 15. Lastly, a third backing 20C having a plurality of second apertures 28 defining vents 30 is provided. In an embodiment, the backings 20A, 20B, 20C each comprise a polymeric material having a heat melt adhesive.

Figure 5:
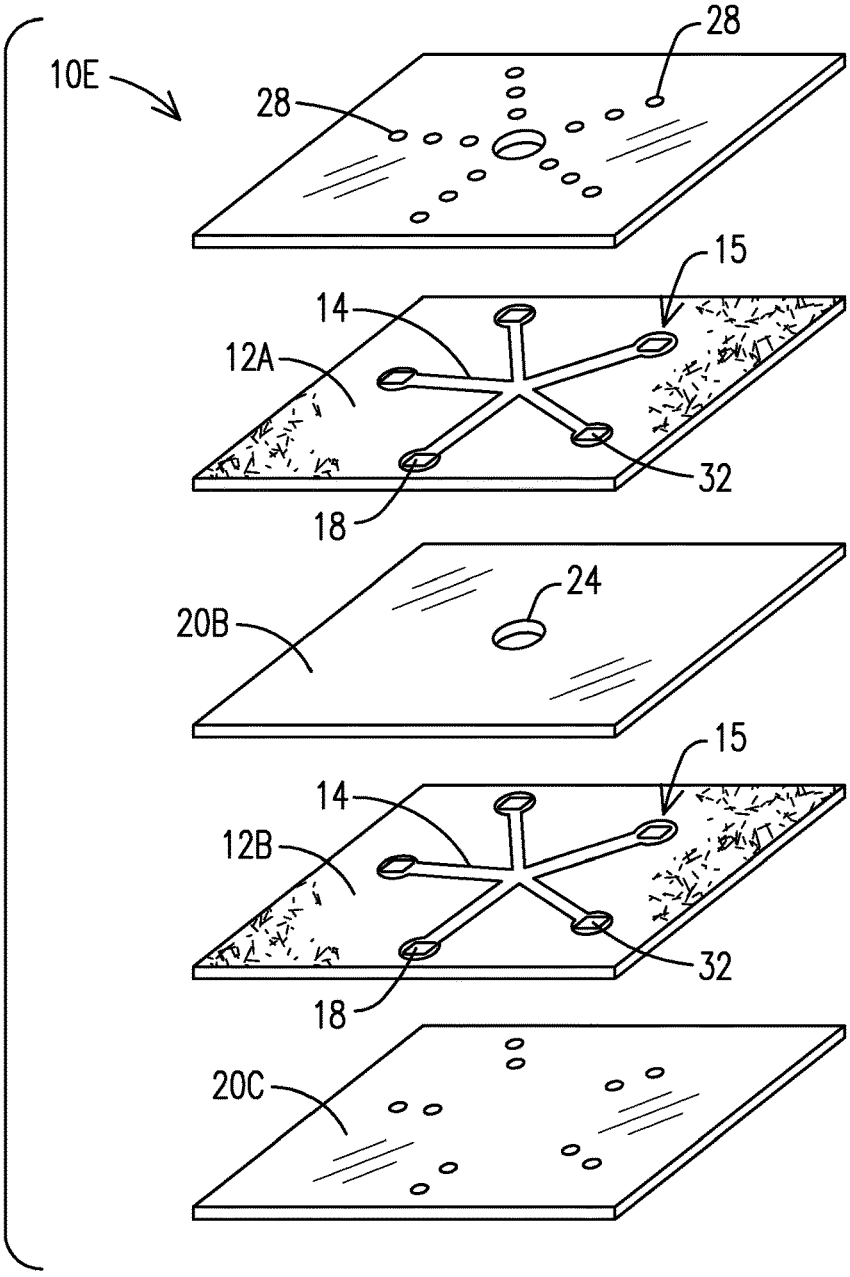
FIG. 5 is an exploded view of a three-dimensional microfluidic device in accordance with yet another aspect of the present invention.
Figure 6:
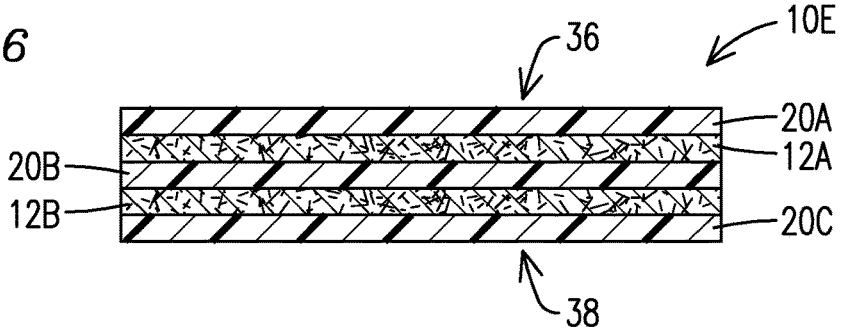
FIG. 6 comprises a side view of the microfluidic device of FIG. 5 upon lamination in accordance with yet another aspect of the present invention.

When laminated under suitable temperature and pressure, the device 10E is enclosed as shown in FIG. 5. The device 10E has reaction channels 14 defined on a top portion of the device 10E to provide one set of test results and channels 14 defined on a bottom portion of the device 10E to provide another set of results. In this way, testing capacity is increased. For example, the additional reaction sites could be used for test redundancy to reduce error or improve accuracy. Alternatively, the additional reaction channels 14 could be used as calibration points where control solutions can be run to improve accuracy.

Alternatively, no aperture may be provided in the second backing 20B, but apertures 24 that serve as sample ports 26 may be provided in the first backing 20A and third backing 20C as described herein such that a first sample may be introduced and allowed to flow to the reaction channels 14 of substrate 12A while a second sample may be introduced and allowed to flow to the reaction channels 14 of substrate 12B.

In any of the embodiments described herein, a single device may be formed or sheets comprising multiple devices may be formed, and then cut into individual devices as desired. In certain embodiments, one or more filters, such as a whole blood filter (not shown) as are known in the art may be provided to contact the sample prior to contact of the sample with the substrate 12. The whole blood filter serves to remove at least a portion of the platelets, red blood cells, and/or white blood cells prior to the contact of the sample with the substrate(s).

The microfluidic devices described herein may be utilized for any suitable application, such as for health-related analyses (e.g., medical diagnostics, water purity, food quality, etc.). Once the sample has been introduced and the desired duration has expired for the desired assay has been completed, the result may be determined by suitable methods and equipment. In certain embodiments, the assays provide for colorimetric results, which may be qualitative and/or semi-quantitative. The result may be compared, for example, to a standard chart, such as a pH chart, which provides a template to which to compare colorimetric results. In another embodiment, the assay results are compared to values of a calibration curve created from a plurality of standard samples having predetermined concentrations as is well-known in the art.

In an embodiment, the assay results may be recorded by taking an image thereof. The images can be recorded and stored on smart phones, scanners, cameras, and the like. In certain embodiments, an image is taken of the relevant portion of the device before and after the testing for comparison utilizing a suitable software program, such as the Eyedropper tool from Adobe Systems, Inc. Specific properties, such as intensity, can be measured from the recorded images and compared to values of a calibration curve as mentioned above. In an embodiment, the recorded images may be transmitted and/or stored on a computer comprising a microprocessor comprising hardware or software configured for processing and analysis of the imaging data. In certain embodiments, the data and/or results may be transmitted remote site over a network.

Aspects of the present invention are demonstrated by the following examples, which are not intended to be limiting in any manner.

EXAMPLES

Example 1

The following example illustrates the simple construction of a device in accordance with an aspect of the present invention utilizing common, readily available consumer product. Channels were hand drawn in one step on paper towels using a Sharpie® permanent marker. The permanent marker material is believed to spread into the pores of the paper, thereby creating a barrier to diffusion of a sample and providing predefined channels.

Laminating pouches for identification (ID) cards (68 mm×98 mm×0.254 mm thickness) or for letters (229 mm×292 mm×0.0762 or 0.254 mm) were used for the enclosing material. A hole was punched for a sample port using a paper punch and holes were punched using a push pin. The push pins holes allow for sufficient capillary action for a sample to travel to the reaction sites. Once the holes were punched in the paper, the paper was placed in the pouch and inserted into a laminator (GB Heatseal H25) that sealed and formed the device within 15 seconds.

Example 2

A number of devices were tested using aqueous solutions containing glucose at various pH levels. A 20 μL sample was utilized for introduction into each device. The sample was introduced and allowed to travel through each reaction channel to a test strip laminated at a reaction site in each device. The color change was recorded. The "eyedropper" tool of Adobe Photoshop was utilized to take samples from the reaction sites of the recorded image. The intensity of red, green, blue, or combinations thereof was plotted vs. measured concentrations utilizing RAPIDLab 1265 software. Three points were analyzed per reaction site and averaged. The sites were averaged using n=3 per level.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The following is a numbered list of non-limiting, illustrative embodiments of the inventive concepts disclosed herein:

1. An illustrative microfluidic device comprising:

a porous substrate;

a plurality of reaction channels disposed on a first side of the porous substrate, the reaction channels defined by a barrier material disposed on the substrate in a user-defined pattern; and at least one reagent disposed within each reaction channel in an amount effective to test for the presence of at least one analyte or property in a sample introduced to the device.

2. The illustrative device of embodiment 1, wherein the substrate is disposed within a housing comprising a first backing and a second backing, the porous substrate disposed between the first backing and the second backing.

3. The illustrative device of embodiment 2, wherein at least one of the first backing or the second backing comprises at least a first aperture and a second aperture defined therein, wherein the first aperture serves as a sample port for the device, and wherein the second aperture serves as a vent for the device to allow for capillary flow of a sample introduced to the device through each reaction channel.

4. The illustrative device of embodiment 2, wherein the housing defines a laminate structure and the substrate is laminated between the first backing and the second backing.

5. The illustrative device of embodiment 3, further comprising a second substrate having a plurality of reaction channels disposed between the second backing and a third backing in the laminate structure, wherein at least one of the second backing and the third backing comprises a first aperture for allowing sample access to the second substrate.

6. The illustrative device of embodiment 1, wherein the at least one reagent is disposed on a test strip within each reaction channel.

7. The illustrative device of embodiment 1, wherein the test strip comprises a plurality of reagents disposed thereon to test for a plurality of different analytes or properties of a sample introduced to the device.

8. The illustrative device of embodiment 7, wherein the plurality of reagents are effective for testing for a member selected from the group consisting of glucose, bilirubin, ketones, specific gravity, blood, pH, protein, urobilinogen, nitrites, leukocytes, and esterases.

9. The illustrative device of embodiment 1, wherein the porous substrate comprises a paper towel.

10. The illustrative device of embodiment 1, wherein the barrier material has a lower porosity or a higher degree of hydrophobicity than the substrate so as to maintain a sample within a boundary defined by the barrier material.

11. The illustrative device of embodiment 10, wherein the barrier material comprises a consumer product.

12. The illustrative device of embodiment 10, wherein the barrier material comprises a material selected from the group consisting of a hydrophobic polymer, permanent ink, and wax.

13. The illustrative device of embodiment 12, wherein the barrier material comprises a product selected from the group consisting of a permanent marker and correction fluid.

14. A method of manufacturing a microfluidic device comprising:

defining at least one reaction channel on a first side of a porous substrate by disposing on the substrate a barrier material in a pattern; and disposing at least one reagent within the at least one reaction channel in an amount effective to test for the presence of a predetermined analyte or property of a sample.

15. The illustrative method of embodiment 14, further comprising:

forming at least a first aperture and a second aperture in at least one of a first backing or a second backing of a laminate structure, wherein upon lamination, the first aperture serves as a sample port for the device and the second aperture serves as a vent for the device; and laminating the porous substrate within the laminate structure to form the enclosed microfluidic device.

16. The illustrative method of embodiment 15, wherein the method consists of the defining, disposing, forming, and laminating steps.

17. The illustrative method of embodiment 15, further comprising:

disposing a second substrate between the second backing and a third backing and laminating the first, second, and third backing, and the first and second substrate to define a three-dimensional device.

18. The illustrative method of embodiment 17, wherein at least one of the second backing and the third backing comprises a first aperture for allowing sample access to the second substrate.

19. The illustrative method of embodiment 15, wherein the porous substrate comprises a paper towel, and wherein the barrier material comprises a material selected from the group consisting of a hydrophobic polymer, permanent ink, and wax.

20. The illustrative device of embodiment 15, wherein the barrier material comprises a product selected from the group consisting of a permanent marker and correction fluid.

The invention claimed is:

1. A microfluidic device comprising:

a porous substrate, the porous substrate comprising a first side and a second side;

a plurality of reaction channels disposed on the first side of the porous substrate, the plurality of reaction channels being disposed on the first side of the porous substrate in a user-defined pattern, each reaction channel of the plurality of reaction channels comprising at least one boundary comprising at least one barrier material, the at least one boundary comprising at least a bottom boundary comprising the at least one barrier material; and at least one reagent disposed within each reaction channel of the plurality of reaction channels to provide a colorimetric analysis of at least one analyte or property in a sample introduced to the microfluidic device, wherein the microfluidic device comprises a housing comprising a first backing comprising at least a first aperture defined therein and a plurality of second apertures positioned over the plurality of reaction channels, and a second backing.

2. The microfluidic device of claim 1, wherein the first aperture serves as a sample port for the device, and wherein the second aperture serves as a vent for the device to allow for capillary flow of a sample introduced to the microfluidic device through each reaction channel of the plurality of reaction channels.

3. The microfluidic device of claim 1, wherein the housing defines a laminate structure and the substrate is laminated between the first backing and the second backing.

4. The microfluidic device of claim 3, wherein the second substrate comprises a plurality of reaction channels disposed between the second backing and a third backing in the laminate structure, wherein the second backing comprises a third aperture for allowing sample access to the second substrate, further wherein the third backing comprises a plurality of fourth apertures.

5. The microfluidic device of claim 1, wherein the at least one reagent is disposed on a test strip within each reaction channel of the plurality of reaction channels.

6. The microfluidic device of claim 5, wherein the test strip comprises a plurality of reagents disposed thereon to test for a plurality of different analytes or properties of a sample introduced to the microfluidic device, and wherein the plurality of reagents is effective for testing for a member selected from the group consisting of glucose, bilirubin, ketones, specific gravity, blood, pH, protein, urobilinogen, nitrites, leukocytes, and esterases.

7. The microfluidic device of claim 1, wherein the at least one barrier material has a lower porosity or a higher degree of hydrophobicity than the porous substrate so as to maintain a sample within the at least one boundary comprising the at least one barrier material.

8. The microfluidic device of claim 7, wherein the barrier material comprises a material selected from the group consisting of a hydrophobic polymer, permanent ink, and wax.

9. The microfluidic device of claim 8, wherein the at least one barrier material comprises a product selected from the group consisting of a permanent marker, correction fluid, and combinations thereof.

10. A method of manufacturing a microfluidic device comprising:

defining at least one reaction channel on a first side of a porous substrate by disposing the at least one reaction channel on the first side of the porous substrate in a pattern, the at least one reaction channel comprising at least one boundary comprising at least one barrier material, the at least one boundary comprising at least a bottom boundary comprising the at least one barrier material;

disposing at least one reagent within the at least one reaction channel wherein the at least one reagent provides a colorimetric analysis of a predetermined analyte or property of a sample;

forming at least one first aperture and at least one second aperture in at least one of a first backing or a second backing of a laminate structure, the at least one second aperture being disposed over the at least one reaction channel, wherein upon lamination, the first aperture serves as a sample port for the microfluidic device and the second aperture serves as a vent for the microfluidic device; and laminating the porous substrate within the laminate structure to form an enclosed microfluidic device.

11. The method of claim 10, further comprising:

disposing a second substrate between the second backing and a third backing and laminating the first, second, and third backing, and the first and second substrate to define a three-dimensional enclosed microfluidic device.

12. The method of claim 11, wherein at least one of the second backing and the third backing comprises a third aperture for allowing sample access to the second substrate.

13. The method of claim 10, wherein the at least one barrier material comprises a product selected from the group consisting of a permanent marker, correction fluid, and combinations thereof.

* * * * *